US010147518B2

(12) United States Patent
Ooi

(10) Patent No.: US 10,147,518 B2
(45) Date of Patent: Dec. 4, 2018

(54) STRANDED WIRE CONDUCTOR AND INSULATED WIRE

(71) Applicants: AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventor: Hayato Ooi, Mie (JP)

(73) Assignees: AUTONETWORKS TECHNOLOGIES, LTD., Yokkaichi-shi (JP); SUMITOMO WIRING SYSTEMS, LTD., Yokkaichi-shi (JP); SUMITOMO ELECTRIC INDUSTRIES, LTD., Osaka-shi (JP)

( * ) Notice: Subject to any disclaimer, the term of this patent is extended or adjusted under 35 U.S.C. 154(b) by 0 days.

(21) Appl. No.: 15/117,555

(22) PCT Filed: Sep. 10, 2014

(86) PCT No.: PCT/JP2014/073886
§ 371 (c)(1),
(2) Date: Aug. 9, 2016

(87) PCT Pub. No.: WO2015/129081
PCT Pub. Date: Sep. 3, 2015

(65) Prior Publication Data

US 2016/0351299 A1 Dec. 1, 2016

(30) Foreign Application Priority Data

Feb. 26, 2014 (JP) ..... 2014-034838

(51) Int. Cl.
*H01B 7/00* (2006.01)
*H01B 7/28* (2006.01)
(Continued)

(52) U.S. Cl.
CPC ..... *H01B 7/2806* (2013.01); *C23C 18/1689* (2013.01); *C23C 18/1692* (2013.01);
(Continued)

(58) Field of Classification Search
CPC . H01B 1/02; H01B 1/026; H01B 5/08; H01B 5/104; H01B 7/189; H01B 7/009
(Continued)

(56) References Cited

U.S. PATENT DOCUMENTS 3,588,318 A * 6/1971 Ollis ..... H01B 3/30 174/110 S
4,342,814 A * 8/1982 Usuki ..... H01B 3/006 174/120 C
(Continued)

FOREIGN PATENT DOCUMENTS

CN 1906708 A 1/2007
CN 1988055 A 6/2007
(Continued)

OTHER PUBLICATIONS

Feb. 13, 2017 Office Action issued in Chinese Patent Application No. 201480075335.8.
(Continued)

*Primary Examiner* — William H Mayo, III
(74) *Attorney, Agent, or Firm* — Oliff PLC

(57) ABSTRACT

A stranded wire conductor includes a plurality of copper-based element wires which are twisted together, and is subjected to circular compression and then heat treatment. The copper-based element wires have a Ni-based plated layer on the surface. The stranded wire conductor preferably
(Continued)

has a conductor cross-sectional area of 0.25 $mm^2$ or less. An insulated wire includes the stranded wire conductor, and an insulator that coats the outer circumference of the stranded wire conductor.

7 Claims, 1 Drawing Sheet

(51) Int. Cl.

| | |
|---|---|
| ***H01B 1/02*** | (2006.01) |
| ***C25D 5/48*** | (2006.01) |
| ***C25D 5/50*** | (2006.01) |
| ***C25D 7/06*** | (2006.01) |
| ***C23C 18/16*** | (2006.01) |
| ***C25D 3/56*** | (2006.01) |
| ***H01B 5/08*** | (2006.01) |
| ***H01B 7/18*** | (2006.01) |
| *H01B 5/10* | (2006.01) |

(52) U.S. Cl.
CPC ..... *C25D 3/562* (2013.01); *C25D 5/48* (2013.01); *C25D 5/50* (2013.01); *C25D 7/0607* (2013.01); *H01B 1/026* (2013.01); *H01B 5/08* (2013.01); *H01B 7/189* (2013.01); *H01B 5/104* (2013.01); *H01B 7/0009* (2013.01)

(58) Field of Classification Search
USPC ..... 174/110 R, 120 R, 120 AR, 121 R, 174/121 A–121 SR, 125.1
See application file for complete search history.

(56) References Cited

U.S. PATENT DOCUMENTS

| | | | | | |
|---|---|---|---|---|---|
| 4,791,966 | A * | 12/1988 | Eilentropp | B65H 81/08 | 138/122 |
| 4,877,923 | A * | 10/1989 | Sahakian | G01M 3/165 | 174/11 R |
| 5,149,917 | A | 9/1992 | Sawada et al. | | |
| 5,170,010 | A * | 12/1992 | Aldissi | H01B 11/1066 | 174/106 R |
| 5,304,739 | A * | 4/1994 | Klug | H01B 3/443 | 174/102 R |
| 2002/0111411 | A1 | 8/2002 | Hase et al. | | |
| 2002/0129969 | A1 | 9/2002 | Groegl et al. | | |
| 2003/0062190 | A1* | 4/2003 | Kim | H01B 3/306 | 174/149 R |
| 2005/0199414 | A1* | 9/2005 | Kim | H01B 9/006 | 174/110 R |
| 2007/0079984 | A1 | 4/2007 | Nakai et al. | | |
| 2007/0187134 | A1 | 8/2007 | Detian et al. | | |
| 2009/0194314 | A1* | 8/2009 | Varkey | H01B 7/046 | 174/103 |
| 2009/0223713 | A1 | 9/2009 | Detian et al. | | |
| 2009/0250243 | A1* | 10/2009 | Zhu | H01B 7/0291 | 174/120 R |
| 2014/0190724 | A1* | 7/2014 | Mehan | B32B 27/08 | 174/120 SR |
| 2016/0351299 | A1 | 12/2016 | Ooi | | |

FOREIGN PATENT DOCUMENTS

| | | | | | |
|---|---|---|---|---|---|
| JP | 60-211098 | A * | 10/1985 | C25D 5/40 | 174/120 R |
| JP | H01-150314 | U | 10/1989 | | |
| JP | 04-006296 | A * | 1/1992 | C25D 7/06 | 174/120 R |
| JP | H04-17214 | A | 1/1992 | | |
| JP | 04-174911 | A * | 6/1992 | H01B 7/00 | 174/120 R |
| JP | 11-350165 | A * | 12/1999 | C23C 30/00 | 174/120 R |
| JP | 2002-155396 | A * | 5/2002 | C25D 7/06 | 174/120 R |
| JP | 2002-208314 | A | 7/2002 | | |
| JP | 2007-172928 | A | 7/2007 | | |
| JP | 2008-91214 | A | 4/2008 | | |
| JP | 2008-091214 | A * | 4/2008 | H01B 5/10 | |
| JP | 2008-159403 | A | 7/2008 | | |
| JP | 2008-159403 | A * | 7/2008 | H01B 5/08 | |
| JP | 2008-277195 | A | 11/2008 | | |
| JP | 2009-097033 | A | 5/2009 | | |

OTHER PUBLICATIONS

Jul. 11, 2017 Office Action issued in Chinese Patent Application No. 201480075335.8.
Oct. 7, 2014 Search Report issued in International Patent Application No. PCT/JP2014/073886.
Sep. 9, 2016 International Preliminary Report on Patentability issued in International Patent Application No. PCT/JP2014/073886.
Jul. 26, 2017 Extended European Search Report issued in European Application No. 14884247.9.
Oct. 24, 2017 Office Action issued in Chinese Patent Application No. 201480075335.8.
Mar. 13, 2018 Office Action issued in European Patent Application No. 14884247.9.
Feb. 2, 2018 Office Action issued in Chinese Patent Application No. 201480075335.8.
Aug. 13, 2018 Office Action issued in European Patent Application No. 14 884 247.9.

* cited by examiner

STRANDED WIRE CONDUCTOR AND INSULATED WIRE

TECHNICAL FIELD

The present invention relates to a stranded wire conductor and an insulated wire.

BACKGROUND ART

Conventionally, in the field of vehicles such as automobiles, there is known an insulated wire in which an insulator coats the outer circumference of a stranded wire conductor having a plurality of conductor element wires twisted together.

As the stranded wire conductor, specifically, Patent Document 1 discloses a stranded wire conductor including a stainless element wire and a plurality of bare copper element wires that are twisted together on the outer circumference of the stainless element wire. Further, the document describes a technology for softening copper in which the bare copper element wires is subjected to heat treatment so as to improve the elongation which was deteriorated by work-hardening after the bare copper element wires were twisted together and subjected to circular compression.

PRIOR ART DOCUMENT

Patent Document

Patent Document 1: JP-A-2008-159403

SUMMARY OF THE INVENTION

Problem to be Solved by the Invention

However, the conventional technology has the following problem. That is, the insulated wire is sometimes used in a high-temperature oil such as a high-temperature ATE and CVT fluid, for example. In this case, there is a fear that the bare copper element wires forming the stranded wire conductor are corroded by sulfur component contained in the oil. The corrosion of the bare copper element wires deteriorates the strength and electric conductivity of the stranded wire conductor.

In order to prevent the corrosion, it is possible that a Sn plated layer is formed on the surface of the bare copper element wire. However, the Sn plate has a relatively low melting point. Therefore, when the heat treatment is performed at a temperature at which copper softens, the Sn plated layer melts and the Sn plated layer easily falls away. Therefore, it is difficult to obtain a stranded wire conductor that exhibits a good corrosion resistance in a high-temperature oil. Particularly, a small-diameter conductor in which the conductor cross-section of the stranded wire conductor is 0.25 $mm^2$ or less is easily affected by the heat treatment, and therefore, the Sn plated layer is likely to melt.

The present invention has been made in view of the background described above to provide a stranded wire conductor in which the corrosion in a high-temperature oil can be suppressed, and an insulated wire using the stranded wire conductor.

Means for Solving the Problem

An aspect of the present invention is a stranded wire conductor subjected to circular compression and then heat treatment, the stranded wire conductor including a plurality of copper-based element wires twisted together, in which the copper-based element wires have a Ni-based plated layer on a surface thereof.

Another aspect of the present invention is an insulated wire including: the stranded wire conductor; and an insulator that coats an outer circumference of the stranded wire conductor.

Effects of the Invention

In the stranded wire conductor, the copper-based element wire includes the Ni-based plated layer on the surface. The Ni-based plate has a higher melting point, compared to a Sn plate. Further, the melting point of the Ni-based plate is higher than the softening temperature of a copper material composing the copper-based element wire. Therefore, even in the case where the stranded wire conductor is subjected to the heat treatment after subjected to the circular compression in order to soften the copper material, the Ni-based plated layer hardly melts, and is unlikely to fall away. Accordingly, in the stranded wire conductor, the corrosion in a high-temperature oil can be suppressed. As a result, even in the case where the stranded wire conductor is exposed to a high-temperature oil, the deterioration of the strength and electric conductivity can be suppressed. Further, because the stranded wire conductor is subjected to the heat treatment after subjected to the circular compression, the stranded wire conductor can secure an adequate elongation.

The insulated wire includes the stranded wire conductor and the insulator that coats the outer circumference of the stranded wire conductor. Therefore, the insulated wire is excellent in the corrosion resistance of the conductor in a high-temperature oil.

MODE FOR CARRYING OUT THE INVENTION

Figure 1:
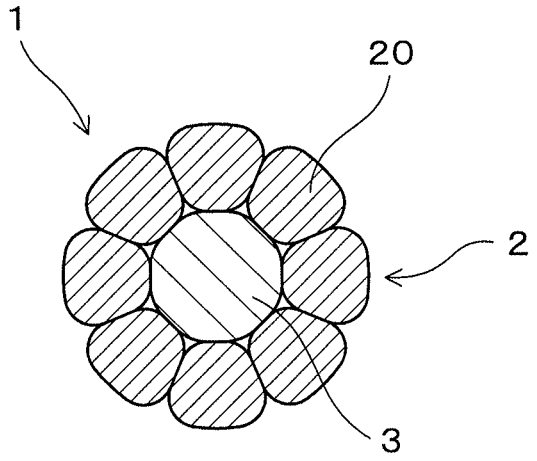
FIG. 1 is a cross-sectional view of a stranded wire conductor in Example 1.

It is preferable that the stranded wire conductor has a conductor cross-sectional area of 0.25 $mm^2$ or less. A stranded wire conductor having a conductor cross-sectional area of 0.25 $mm^2$ or less, because of its small diameter, is easily heated in the heat treatment to be performed after the circular compression. Therefore, conventionally in the stranded wire conductor having a conductor cross-sectional area of 0.25 $mm^2$ or less, it is particularly difficult to use a copper-based element wire having a Sn plated layer formed on the surface thereof, and a bare copper element wire has to be used inevitably. Therefore, in the stranded wire conductor having a conductor cross-sectional area of 0.25 $mm^2$ or less, it is particularly difficult to suppress the corrosion in a high-temperature oil. However, the stranded wire conductor employs such a configuration as described above. Accordingly, the stranded wire conductor can exert a sufficient corrosion resistance in a high-temperature oil, even when the conductor cross-sectional area is 0.25 $mm^2$ or less.

From the standpoint of diameter size reduction, weight saving and the like, the conductor cross-sectional area, preferably can be 0.2 $mm^2$ or less, more preferably 0.18 $mm^2$ or less, and further preferably 0.15 $mm^2$ or less. Here, from the standpoint of ease of production, strength, electric conductivity and the like, the conductor cross-sectional area can be 0.1 $mm^2$ or greater.

In the stranded wire conductor, a base material forming the copper-based element wire is composed of copper or a copper alloy. Then, the copper-based element wire has the Ni-based plated layer on the surface. Specifically, the Ni-based plated layer is a Ni plate or a Ni alloy plate. Here, the plate may be formed by electroplating, or may be formed by electroless plating. Here, from the standpoint of the enhancement of the corrosion resistance in a high-temperature oil, and the like, the thickness of the Ni-based plated layer, preferably can be 0.1 to 5.0 μm, more preferably 0.3 to 3.0 μm, further preferably 0.5 to 1.5 μm, and further more preferably 0.8 to 1.3 μm.

The outer diameter of the copper-based element wire is preferably in a range of 0.13 to 0.15 mm, and more preferably in a range of 0.135 to 0.145 mm in a state before being subjected to the circular compression. Here, the abovementioned outer diameter of the copper-based element wire does not include the thickness of the Ni-based plated layer.

Specifically, for example, the stranded wire conductor can adopt a configuration in which a tension member for resisting tensile force is disposed at a conductor center of the stranded wire conductor. More specifically, the stranded wire conductor can adopt a configuration including a tension member for resisting tensile force, which is disposed at a conductor center of the stranded wire conductor, and an outermost layer formed by the plurality of copper-based element wires that are twisted together on the outer circumference of the tension member.

In this case, when tensile force acts on the stranded wire conductor, the tension member resists the tensile force, and therefore, the tensile force applied to the copper-based element wire is alleviated. Accordingly, it makes possible to obtain a stranded wire conductor in which the disconnection of the copper-based element wire hardly occurs. Further, in this case, the disconnection caused by the corrosion is also suppressed since the corrosion of the copper-based element wire is suppressed, so that the effect of suppressing the disconnection is increased. Accordingly, this configuration is particularly useful for the small-diameter stranded wire conductor having a conductor cross-sectional area of 0.25 $mm^2$ or less.

As a material for the tension member, for example, iron, stainless, nickel or the like can be used. Preferably, the material for the tension member may be stainless. This is because stainless is advantageous for enhancement of the corrosion resistance of the stranded wire conductor in a high-temperature oil. Further, the outer diameter of the tension member, in a state before being subjected to the circular compression, preferably should be greater than the outer diameter of the copper-based element wire. Specifically, the outer diameter of the tension member, in a state before being subjected to the circular compression, preferably can be 0.20 to 0.30 mm, and more preferably should be 0.22 to 0.23 mm.

In addition, for example, the stranded wire conductor can adopt a configuration including a copper-based central element wire disposed at the conductor center and an outermost layer formed by the copper-based element wires that are twisted together on the outer circumference of the copper-based central element wire. Here, in this case, the copper-based central element wire includes the Ni-based plated layer on the surface. The outer diameter of the copper-based central element wire, in a state before being subjected to the circular compression, may be the same diameter as that of the copper-based element wire forming the outermost layer, or may be a different diameter. Further, the copper-based central element wire may be composed of the same copper material as the copper-based element material, or may be composed of a copper material that is different in the kind, proportion and others of the alloy element.

Specifically, in the stranded wire conductor, it is preferable that the number of the copper-based element wires be seven or eight and the copper-based element wires form an outermost layer of the stranded wire conductor.

This case makes it possible to easily provide the small-diameter stranded wire conductor having a conductor cross-sectional area of 0.25 $mm^2$ or less with a good corrosion resistance in a high-temperature oil.

The stranded wire conductor is subjected to the circular compression in a radial direction of the stranded wire. The circular compression can be performed at the time of twisting of the copper-based element wires, or after the twisting. Whether or not the stranded wire conductor has been subjected to the circular compression can be judged, for example, by observing the conductor cross-section to check whether an outer shape of the copper-based element wire forming the outermost layer apparently has any changes due to the circular compression. Further, whether the stranded wire conductor is subjected to the heat treatment can be judged by analizing the chemical component composition of the copper material composing the copper-based element wire, the elongation property and the like. Such analyze is enabled on the basis of the fact that a bad elongation property is exhibited when the copper material is not softened after the circular compression.

The insulated wire includes the insulator on the outer circumference of the stranded wire conductor. Any compositions including various resins and rubbers (including elastomers) having an electric insulation property are available for the insulator. The resins or rubbers may be used singly or in concurrent combination of two or more kinds. Specific examples of the aforesaid resin can include vinyl chloride-based resin, polyolefin-based resin, polysulfone-based resin and the like.

Preferably, the resin should be the polysulfone-based resin. In this case, the high-temperature oil resistance and abrasion resistance of the insulator are enhanced. Therefore, it is possible to obtain an insulated wire that is particularly appropriate for the use in a high-temperature oil under a vibration environment, as a result of a synergetic effect with the effect of the stranded wire conductor having a good corrosion resistance in a high-temperature oil. Specific examples of the polysulfone-based resin can include polysulfone, polyether sulfone, polyphenyl sulfone and the like. The polysulfone-based resins may be used singly or in concurrent combination of two or more kinds.

The insulator may contain one kind or two or more kinds of various addition agents that are generally used in electric cables. Specific examples of the addition agent can include bulking agents, flame retardants, antioxidants, age inhibitors, lubricants, plasticizers, copper inhibitors, pigments, and the like.

Here, the above-described configurations, as necessary, can be arbitrarily combined for some purposes, for example, for obtaining the above-described functions and effects, or the like.

EXAMPLE

Hereinafter, a stranded wire conductor and an insulated wire in examples will be described with use of drawings. Here, identical members will be described with use of identical reference numerals.

Example 1

A stranded wire conductor in Example 1 will be described with use of FIG. 1. As shown in FIG. 1, a stranded wire conductor 1 in the example includes a plurality of copper-based element wires 20 that are twisted together, and are subjected to the circular compression, and then the heat treatment. The copper-based element wires 20 include a Ni-based plated layer (not illustrated) on its surface. In the following, this will be described in detail.

In the example, the base material of the copper-based element wires 20 is composed of copper or a copper alloy. The Ni-based plated layer formed on the surface of the copper-based element wires 20 is composed of a Ni plate or a Ni alloy plate. In the example, the thickness of the Ni-based plated layer is 0.1 to 5.0 μm. The outer diameter of the copper-based element wires 20 is 0.14 mm, in a state before being subjected to the circular compression.

Further, in the stranded wire conductor 1 in the example, a tension member 3 for resisting tensile force is disposed at the conductor center of the stranded wire conductor 1. Specifically, the stranded wire conductor 1 includes the tension member 3 disposed at the conductor center of the stranded wire conductor 1, and an outermost layer 2 formed by the plurality of copper-based element wires 20 that are twisted together on the outer circumference of the tension member 3. More specifically, the tension member 3 is a stainless wire. The outer diameter of the tension member 3 is greater than the outer diameter of the copper-based element wire 20, in a state before subjected to the circular compression, and specifically, is 0.225 mm. Specifically, the outermost layer 2 is configured by eight copper-based element wires 20 each of which has the Ni-based plated layer formed on the surface.

The stranded wire conductor 1 can be produced as follows. The eight copper-based element wires 20 each of which has a circular cross-section and each of which has the Ni-based plated layer formed on the surface are twisted together on the outer circumference of the tension member 3 that has a circular cross-section. At the time of the twisting, the circular compression is performed in a radial direction of the stranded wire. After the circular compression, in order to soften the copper or copper alloy composing the copper-based element wires 20, the heat treatment is performed under a temperature condition that is appropriate for the softening temperature of the copper or copper alloy. Here, the heat treatment temperature is set so as to be lower than the melting point of the Ni plate or Ni alloy plate. As the method of the heat treatment, an electrically heating method or the like can be employed.

In the stranded wire conductor 1, the conductor cross-sectional area is made to be 0.25 $mm^2$ or less by the circular compression. In the example, specifically, the conductor cross-sectional area is 0.13 $mm^2$.

Next, the functions and effects of the stranded wire conductor in the example will be described.

The stranded wire conductor 1 in the example includes the Ni-based plated layer on the surface of the copper-based element wire 20. The Ni-based plate has a higher melting point, compared to a Sn plate. Further, the melting point of the Ni-based plate is higher than the softening temperature of the copper material composing the copper-based element wire 20. Therefore, even in the case where the stranded wire conductor 1 is subjected to the heat treatment to soften the copper material after being subjected to the circular compression, the Ni-based plated layer hardly melts, and the Ni-based plated layer is unlikely to fall away. Accordingly, in the stranded wire conductor 1, the corrosion in a high-temperature oil can be suppressed. As a result, even when the stranded wire conductor 1 is exposed to a high-temperature oil, it is possible to suppress deterioration of the strength and the electric conductivity. Further, the stranded wire conductor 1 is subjected to the heat treatment after subjected to the circular compression, so that an adequate elongation is secured.

Example 2

Figure 2:
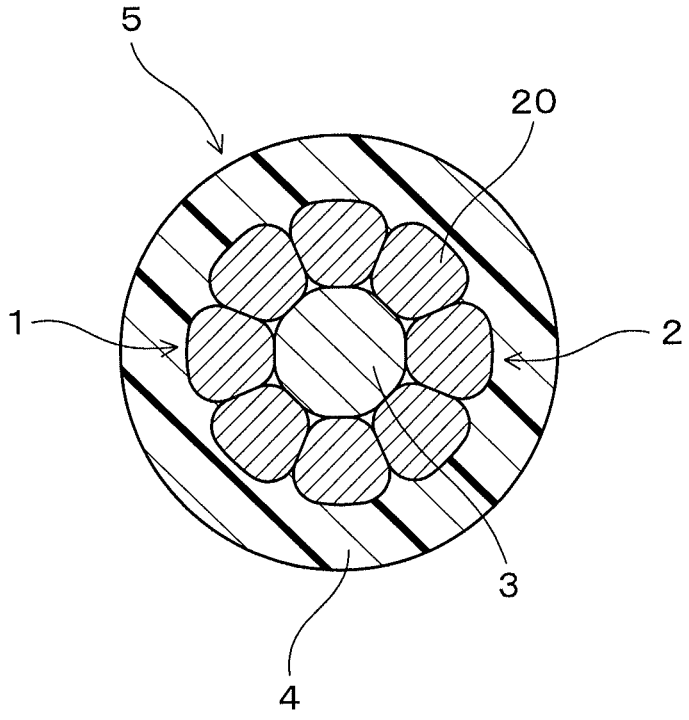
FIG. 2 is a cross-sectional view of an insulated wire in Example 2.

An insulated wire in Example 2 will be described with use of FIG. 2. As shown in FIG. 2, an insulated wire 5 in the example includes a stranded wire conductor 1, and an insulator 4 that coats the outer circumference of the stranded wire conductor 1. The stranded wire conductor 1 is the stranded wire conductor 1 in Example 1.

In the example, specifically, the insulator is composed of a resin composition containing at least one kind of resin selected from the group consisting of polysulfone, polyether sulfone and polyphenyl sulfone. The thickness of the insulator is 0.10 to 0.35 mm.

Next, the functions and effects of the insulated wire in the example will be described.

The insulated wire 5 in the example includes the stranded wire conductor 1, and the insulator 4 that coats the outer circumference of the stranded wire conductor 1. Therefore, the insulated wire 5 is excellent in the corrosion resistance of the conductor in a high-temperature oil.

Stranded wire conductor samples having different configurations were made and evaluated as follows. An experimental example will be described.

Experimental Example

Eight Ni-plated copper element wires of ϕ0.14 mm each of which had a Ni electroplated layer formed on the surface were twisted together on the outer circumference of a stainless wire of ϕ0.225 mm to prepare a stranded wire material. Here, the Ni-plated copper element wires were not subjected to the heat treatment for softening. Further, at the time of forming the stranded wire material, the circular compression was performed for the stranded wire material, such that the conductor cross-sectional area became 0.13 $mm^2$. Thereafter, the electric heating was applied to the stranded wire material subjected to the circle compression by energizing with current of 20 A at voltage of 20 V for 1 second, so that the Ni-plated copper element wires were softened. Thus, a stranded wire conductor referred to as Sample 1 was obtained.

A stranded wire conductor referred to as Comparative sample 1 was prepared in the same way as Sample 1, except that bare copper element wires were used instead of the Ni-plated copper element wires used in preparation for Sample 1. Here, the bare copper element wires as used in Comparative sample 1 was not subjected to the heat treatment for softening.

A stranded wire conductor referred to as Comparative sample 2 was prepared in the same way as Sample 1, except that Sn-plated copper element wires each of which had a Sn electroplated layer formed on the surface were used instead of the Ni-plated copper element wires used in preparation for Sample 1. Here, the Sn-plated copper element wires as used in Comparative sample 2 ware not subjected to the heat treatment for softening.

—Corrosion Resistance in High-Temperature Oil—

Each stranded wire conductor was immersed in ATF (Nissan genuine product ATF: NS-3) at 200° C. for 2000 hours, and thereafter the conductor surface was visually observed. In the case where corrosion did not appear on the conductor surface, the stranded wire conductor was considered as passing and judged as "A". In the case where the corrosion appeared on the conductor surface, the stranded wire conductor was rejected and judged as "C".

—Strength—

For each stranded wire conductor before subjected to immersion in the high-temperature oil and each stranded wire conductor after subjected to immersion in the high-temperature oil, a tension test was performed under an identical condition. In the case where the tensile strength was deteriorated by 10% or more after the immersion in the high-temperature oil, it was determined that the deterioration of the strength was recognized, so that the stranded wire conductor was judged as "C". In the case where the deterioration of the tensile strength was within 10% between before and after the immersion in the high-temperature oil, it was determined that the deterioration of the strength was not recognized, so that the stranded wire conductor was judged as "A".

—Electric Conductivity—

For each stranded wire conductor before the immersion in the high-temperature oil and each stranded wire conductor after the immersion in the high-temperature oil, the electric conductivity was measured under an identical condition. In the case where the electric conductivity was deteriorated by 10% or more after the immersion in the high-temperature oil, it was determined that the deterioration of the electric conductivity was recognized, so that the stranded wire conductor was judged as "C". In the case where the deterioration of the electric conductivity was within 10% between before and after the immersion in the high-temperature oil, it was determined that the deterioration of the electric conductivity was not recognized, so that the stranded wire conductor was judged as "A".

Table 1 collectively shows the evaluation results.

TABLE 1

| | Sample 1 | Comparative sample 1 | Comparative sample 2 |
|---|---|---|---|
| Corrosion resistance in high-temperature oil | A | C | C |
| Strength | A | C | C |
| Electric conductivity | A | C | C |

As shown in Table 1, in the stranded wire conductor of Comparative sample 1, the bare copper element wires were twisted together. Therefore, the bare copper element wires were corroded in the high-temperature oil. Further, in the stranded wire conductor of Comparative sample 1, the strength and the electric conductivity were deteriorated due to the corrosion of the bare copper element wires.

In the stranded wire conductor of Comparative sample 2, the Sn-plated copper element wires were twisted together. Therefore, the Sn-plated copper element wires were corroded in the high-temperature oil. This is because the Sn plated layers of the Sn-plated copper element wires melted and the Sn plated layers fell away when the stranded wire material was subjected to the heat treatment for softening after the circular compression. As a result, in the stranded wire conductor of Comparative sample 2, the strength and the electric conductivity were deteriorated, similarly to the stranded wire conductor of Comparative sample 1.

In contrast, in the stranded wire conductor of sample 1, the Ni-plated copper element wires are twisted together. Therefore, the Ni-plated copper element wires were not corroded in the high-temperature oil and the stranded wire conductor was confirmed to have a good corrosion resistance. Further, since the corrosion in the high-temperature oil was suppressed in the stranded wire conductor of sample 1, the deterioration of the strength and the electric conductivity could be suppressed.

Thus, the examples of the present invention have been described in detail. The present invention is not limited to the aforementioned examples, and various modifications are possible so long as the spirit of the present invention is not impaired.

The invention claimed is:

1. An insulated wire comprising:

a stranded wire conductor comprising:

a plurality of copper-based element wires twisted together; and an insulator that coats an outer circumference of the stranded wire conductor, wherein:

the stranded wire conductor has been subjected to circular compression and then heat treatment, and has a conductor cross-sectional area of 0.25 $mm^2$ or less, the copper-based element wires have a Ni-based plated layer on a surface thereof, the Ni-based plated layer having been compressed by circular compression and being 0.1 to 5.0 μm thick before the circular compression, the insulator is formed of a resin composition containing at least one kind of resin selected from the group consisting of polysulfone, polyether sulfone, and polyphenylsulfone, and the insulated wire is configured to be used in an oil that is ATF or CVT fluid.

2. The insulated wire according to claim 1, wherein a tension member for resisting tensile force is disposed at a conductor center of the stranded wire conductor.

3. The insulated wire according to claim 1, wherein a number of the copper-based element wires is seven or eight, and the copper-based element wires form an outermost layer of the stranded wire conductor.

4. The insulated wire according to claim 3, wherein a tension member for resisting tensile force is disposed at a conductor center of the stranded wire conductor.

5. The insulated wire according to claim 1, wherein an outer diameter of the copper-based element wires is in a range of 0.13 to 0.15 mm in a state before being subjected to the circular compression, and the outer diameter does not include a thickness of the Ni-based plated layer.

6. The insulated wire according to claim 5, wherein a tension member for resisting tensile force is disposed at a conductor center of the stranded wire conductor.

7. The insulated wire according to claim 5, wherein a number of the copper-based element wires is seven or eight, and the copper-based element wires form an outermost layer of the stranded wire conductor.

* * * * *